US012006077B2

(12) United States Patent
Martins De Vasconcelos

(10) Patent No.: US 12,006,077 B2
(45) Date of Patent: Jun. 11, 2024

(54) PACKAGING DEVICE, PACKAGING METHOD AND PACKAGE FOR VISUAL COMMUNICATION BOARDS

(71) Applicants: VIDROAPLANOS SA, Esmoriz (PT); BI-OFFICE SA, Arada (PT)

(72) Inventor: Andre Gonçalves Martins De Vasconcelos, Ovar (PT)

(73) Assignees: VIDROAPLANOS SA, Esmoriz (PT); BI-OFFICE SA, Arada (PT)

( * ) Notice: Subject to any disclaimer, the term of this patent is extended or adjusted under 35 U.S.C. 154(b) by 69 days.

(21) Appl. No.: 17/792,317

(22) PCT Filed: Jan. 13, 2021

(86) PCT No.: PCT/IB2021/050227
§ 371 (c)(1),
(2) Date: Jul. 12, 2022

(87) PCT Pub. No.: WO2021/144712
PCT Pub. Date: Jul. 22, 2021

(65) Prior Publication Data

US 2023/0054647 A1 Feb. 23, 2023

(30) Foreign Application Priority Data

Jan. 13, 2020 (PT) ..... 116056

(51) Int. Cl.
*B65B 11/00* (2006.01)
*B65B 11/48* (2006.01)
(Continued)

(52) U.S. Cl.
CPC ..... *B65B 11/48* (2013.01); *B65B 11/004* (2013.01); *B65B 23/20* (2013.01); *B65B 35/18* (2013.01);
(Continued)

(58) Field of Classification Search
CPC ..... B65B 11/48; B65B 11/004; B65B 35/18; B65B 55/24; B65B 1/26; B65B 65/003
See application file for complete search history.

(56) References Cited

U.S. PATENT DOCUMENTS 2,940,236 A * 6/1960 Conti ..... B65B 11/48 53/391
3,626,660 A * 12/1971 Dorfmann ..... B65B 11/004 53/376.5
(Continued)

FOREIGN PATENT DOCUMENTS

WO WO-2006035211 A2 * 4/2006 ..... B31B 1/62

*Primary Examiner* — Andrew M Tecco
(74) *Attorney, Agent, or Firm* — The Roy Gross Law Firm, LLC; Roy Gross

(57) ABSTRACT

The present invention refers to a device for packaging visual communication boards and to the respective packaging method, characterized by a set of at least nine sections that comprises feeding the boards (1); fitting the lateral and upper profiles (2), cleaning of the boards (3); placing of the boards in the packaging material (4) and the positioning of the packaging material, the distribution of the bonding product on the surface of the packaging material and the placing of tops on the packaging material (5); executing the bonding of the referred tops on the packaging material; folding the packaging material and package seal (6); sealing the packaging material (7), labelling the package (8); control and wrapping (9) or palletization of the final product.

11 Claims, 11 Drawing Sheets

(51) Int. Cl.

| | |
|---|---|
| ***B65B 23/20*** | (2006.01) |
| ***B65B 35/18*** | (2006.01) |
| ***B65B 51/06*** | (2006.01) |
| ***B65B 55/24*** | (2006.01) |
| ***B65B 61/26*** | (2006.01) |
| ***B65B 65/00*** | (2006.01) |

(52) U.S. Cl.
CPC ..... *B65B 51/06* (2013.01); *B65B 55/24* (2013.01); *B65B 61/26* (2013.01); *B65B 65/003* (2013.01)

(56) References Cited

U.S. PATENT DOCUMENTS

| | | | | |
|---|---|---|---|---|
| 5,195,298 | A * | 3/1993 | Baranowski | B65B 55/24 53/425 |
| 9,962,895 | B2 * | 5/2018 | Ponti | B65B 11/004 |
| 10,787,286 | B2 * | 9/2020 | Christman | B65B 11/48 |
| 10,974,854 | B2 * | 4/2021 | Toro | B65B 11/54 |
| 2019/0039762 | A1 * | 2/2019 | Toro | B65B 59/001 |
| 2020/0198815 | A1 * | 6/2020 | Benin | B65B 35/44 |

* cited by examiner

PACKAGING DEVICE, PACKAGING METHOD AND PACKAGE FOR VISUAL COMMUNICATION BOARDS

CROSS-REFERENCE TO RELATED APPLICATIONS

This application is a National Phase of PCT Patent Application No. PCT/IB2021/050227 having International filing date of Jan. 13, 2021, which claims the benefit of priority of Portugese Patent Application No. 116056, filed Jan. 13, 2020, the contents of which are all incorporated herein by reference in their entirety.

TECHNICAL DOMAIN

The present application is related to a device for automatic packaging of products in industrial production line, method of packaging and the package.

PRIOR ART

It is currently observed that the packaging of visual communication boards is the bottleneck in the process of production and packaging of visual communication boards. This bottleneck is due to the number of people that are necessary to execute the packaging as well as the time required for doing so. The current operations consist in one person placing the package cardboard on a surface with rolls, whereby this board has a support pallet to the workstation. Next the board arriving from a previous post over a conveyor belt is manually placed over a packaging cardboard and this person, with help from another person on the other side of the rolling surface, places the assembly instructions over the cardboard, on the tops of the packaging board, with several folds and creases of the cardboard. These people will seek instructions and accessories from support stations close to the packaging station. Next, the board being in this stage of packaging, it is sent forward over the rolling surface where two other people, once again one on each side of the rolling line, close the flaps of the box over the board and apply adhesive tape in the longitudinal direction of the box. Subsequently they place the label on the box. Finally, they seize the board and place it over a pallet.

These operations require four people working synchronized, with intense physical work effort and with long operation time, higher than that for the assembly of the boards.

The packaging depends on the people and for this reason it becomes irregular from product to product, also showing gaps between the board and the packaging cardboard, weakening the protection of the product in case of wrong handling of the package, or in case of a fall of the packaged product.

SUMMARY

The present application refers to a packaging device for visual communication boards that comprises at least the following sections:

Section 1—feeding of the boards;

Section 2—fitting the lateral and upper profiles;

Section 3—cleaning of boards;

Section 4—placing of boards on packaging material;

Section 5—positioning the packaging material, distribution of bonding product on the surface of the packaging material and placing of tops on the packaging material;

Section 6—folding the packaging material and package seal;

Section 7—sealing the packaging material;

Section 8—labelling the package;

Section 9—control and conditioning.

In one embodiment the section 1 comprises a platform (1.1), consisting of rolls (1.2), and which is adjacent to a belt (1.3); two platforms (1.4), one on each side of a strip belt (1.5), where the strip belt (1.5) is also adjacent to the belt (1.3); a controller (1.6); a suction cup arm (1.7) with electro valve type sensors; and an optical type sensor on the strip belt (1.5).

In another embodiment the section 2 comprises a profile feeder (2.2) formed by four sections, each section consisting of a feeder trough (2.3), where the profile feeder (2.2) is integrated in a bonding product machine (2.4), and where the profile feeder (2.2) comprises a group of pushers (2.1); the bonding product machine (2.4) comprises a bonding product dispenser (2.5) associated to an elevating arm system (2.6).

In yet another embodiment the section 3 comprises a strip belt (3.1), adjacent to an aspiration device (3.2) and where the aspiration device (3.2) comprises a group of rolls (33).

In one embodiment the section 4 comprises a robotic arm (4.1); at least two strip belts (4.4) adjacent to the robotic arm (4.1); a runner and suction cup system (4.2) controlled by electro valve type sensors; a station (4.3) next to the strip belt (4.4); a controller (4.5).

In another embodiment the section 5 comprises a strip belt (5.1); a transport system (5.4) which comprises bonding product dispensers (5.2); two top dispensers (5.3), one on each side of the strip belt (5.1), and which comprise a top dispenser (5.5) each.

In one embodiment the section 6 comprises a strip belt (6.4), at least four mechanical arms (6.1), a guillotine (6.2) and at least two metallic bars (6.3).

In yet another embodiment the section 7 comprises a strip belt (7.1) and a bonding material dispenser (7.2).

In one embodiment the section 8 comprises a roller platform (8.1).

In one embodiment the section 9 comprises electro valve type sensors, strip belts and roller platforms, and an air suction cup system (9.1) assembled on upper runners.

The application further refers to a method for packaging visual communication boards in the described device that comprises the steps of:

feeding the boards in section 1 by means of the movement of the boards on the platform (1.1) and the belt (1.3) until the platforms (1.4), wherein the belt (1.3) moves horizontally to distribute the boards over the platforms (1.4), collecting the boards by means of the arm provided with suction cups (1.7) with a vacuum between 700000 Pa and 800000 Pa and time between 0 and 20 seconds, and placing the boards on the strip belt (1.5), the entire operation being controlled by the controller (1.6);

fitting of lateral and upper profiles in section 2, where the bonding product machine (2.4) dispenses bonding product on the profile tears, and where the profile feeder (2.2) dispenses upper profiles and lateral profiles, pushed by pushers (2.1);

cleaning of the boards in section 3, where the boards are directed to a strip belt (3.1) wherein the aspiration device (3.2) cleans the surface of the board;

placing the boards on the package material of section 4, where the runner and suction cups system (4.2) collects the package material from the station (4.3) and places it on the strip belt (4.4), the robotic arm turns the board 180° and the runner and suction cups system (4.2) places the board over the packaging material;

positioning the packaging material and distribution of the bonding product in section 5, where the bonding product of the packaging material is applied on the packaging material by means of the dispenser (5.2), the top feeders (5.3) dispense tops for the packaging material, and the dispenser (5.2) applies bonding product to the tops;

folding the packaging material and package seal in section 6, where a set of mechanical arms (6.1) pushes the flaps of the packaging material, the guillotine (6.2) centralizes and maintains the position of the board and the package, and the metallic bars (6.3) press the package closed;

sealing the package in section 7, where a dispenser (7.2) dispenses adhesive tape over the flap joining line in the centre of the closed package;

labelling in section 8, for placing the label on the package;

control and conditioning in section 9, where the quality control and conditioning of several packages is carried out.

GENERAL DESCRIPTION

The present invention refers to a device for packaging visual communication boards, the package and the respective packaging method, characterized by a set of at least nine sections or sectors that comprises feeding the boards; fitting the lateral and upper profiles, cleaning of the boards; placing of the boards in the packaging material and the positioning of the package material, the distribution of the bonding product on the surface of the packaging material and the placing of tops on the packaging material; executing the bonding of the referred tops on the packaging material; folding the packaging material and package sealing itself; sealing the packaging material, labelling the package; control and wrapping or palletization of the final product.

BRIEF DESCRIPTION OF DRAWINGS

For an easier understanding of the present application there are figures attached which represent preferred embodiments that, however, do not intend to limit the technology herein disclosed.

1—Feeding section of the boards; 2—Section for fitting the lateral and upper profiles; 3—Section for cleaning the boards; 4—Section for placing the boards in the packaging material; 5—section for positioning the packaging material, distribution of bonding product on the surface of the package material and placing the tops and the bonding thereof in the packaging material; 6—Section for folding the packaging material and package sealing; 7—Section for package sealing; 8—Labelling section; 9—Control and conditioning section.

Figure 1:
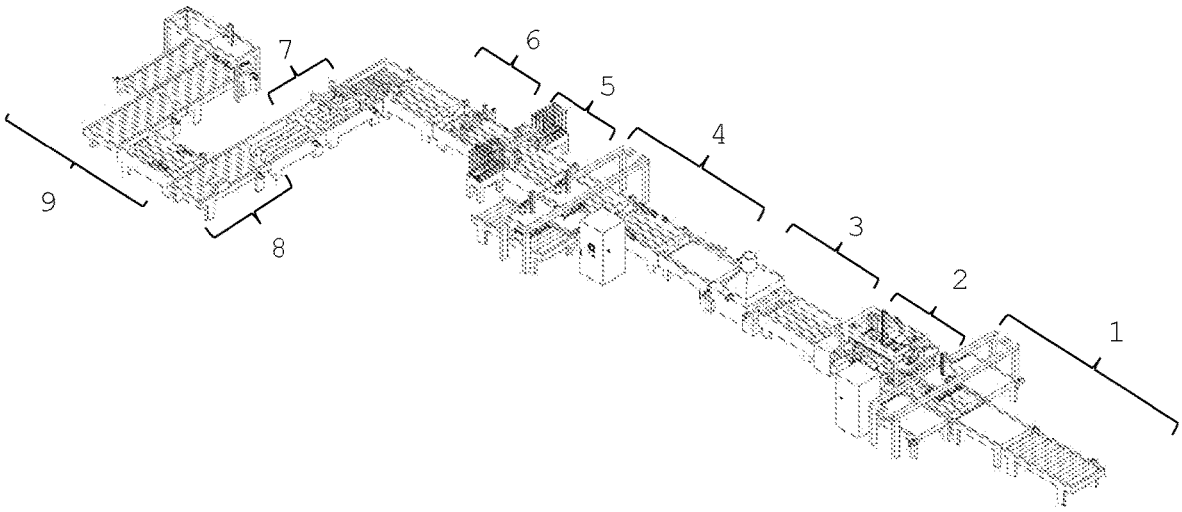
FIG. 1 shows a device for packaging boards of the present application, where the references represent.
Figure 2:
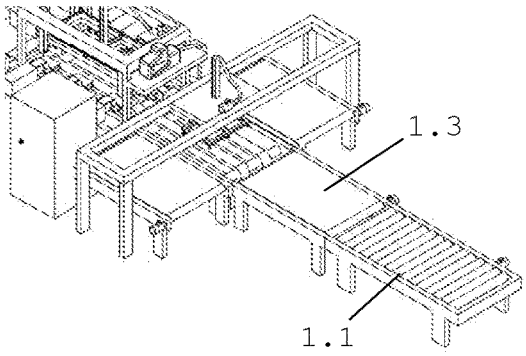

FIG. 2 shows the platform (1.1) and the belt (1.3) of section 1.

Figure 3:
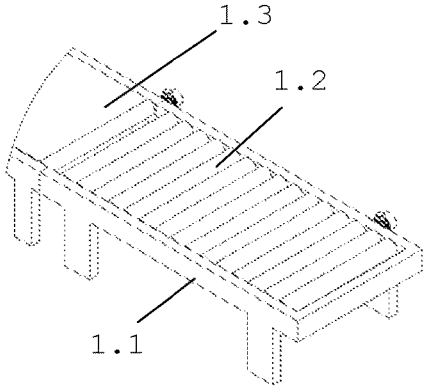

FIG. 3 shows the platform (1.1), the rolls (1.2) and the belt (1.3) of section 1.

Figure 4:
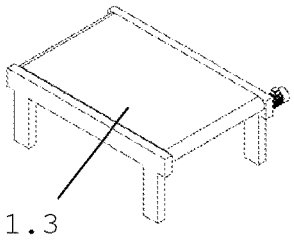

FIG. 4 shows the belt (1.3) of section 1.

Figure 5:
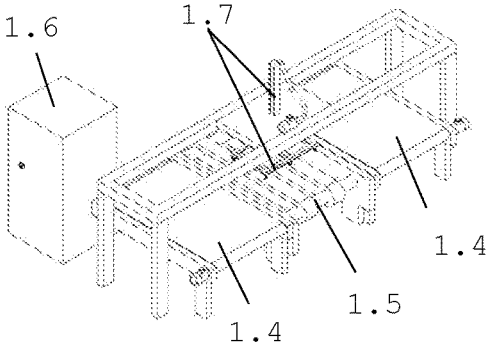

FIG. 5 shows the platforms (1.4), the strip belt (1.5), the controller (1.6) and the arm with suction cups (1.7) of section 1.

Figure 6:
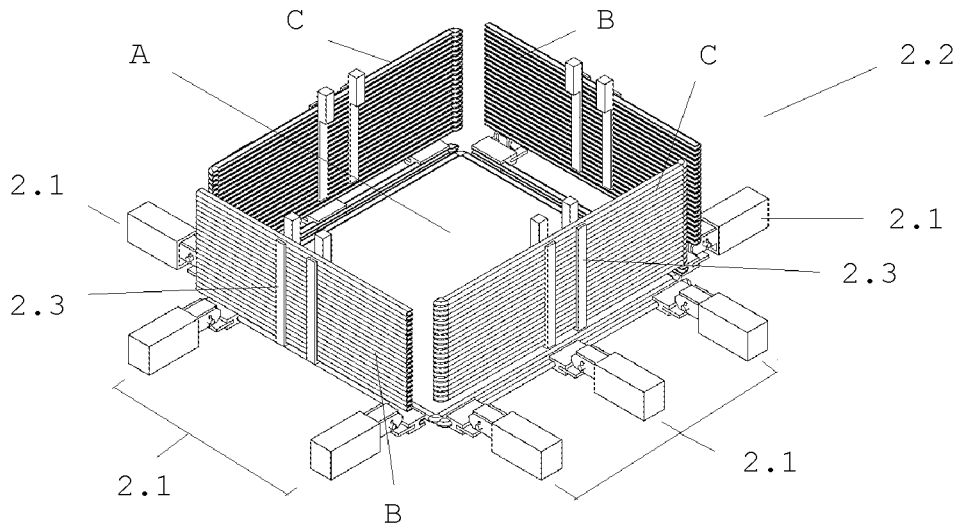

FIG. 6 shows the profile feeder (2.2) with the pushers (2.1), the feeder trough (2.3), the board (A), the upper profiles (B), the lateral profiles (C) of section 2.

Figure 7:
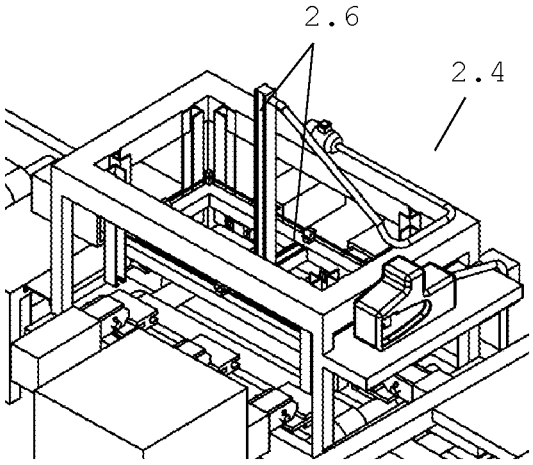

FIG. 7 shows the bonding product machine (2.4) with the elevating arm system (2.6) of section 2.

Figure 8:
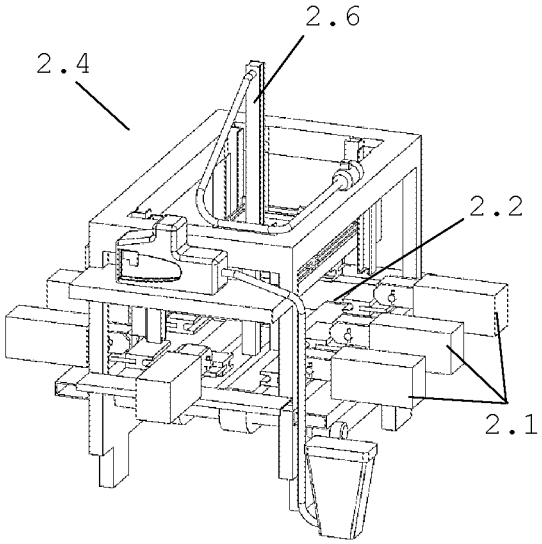

FIG. 8 shows the bonding product machine (2.4) with the elevating arm system (2.6) and the pushers (2.1) of the profile feeder (2.2) in section 2.

Figure 9:
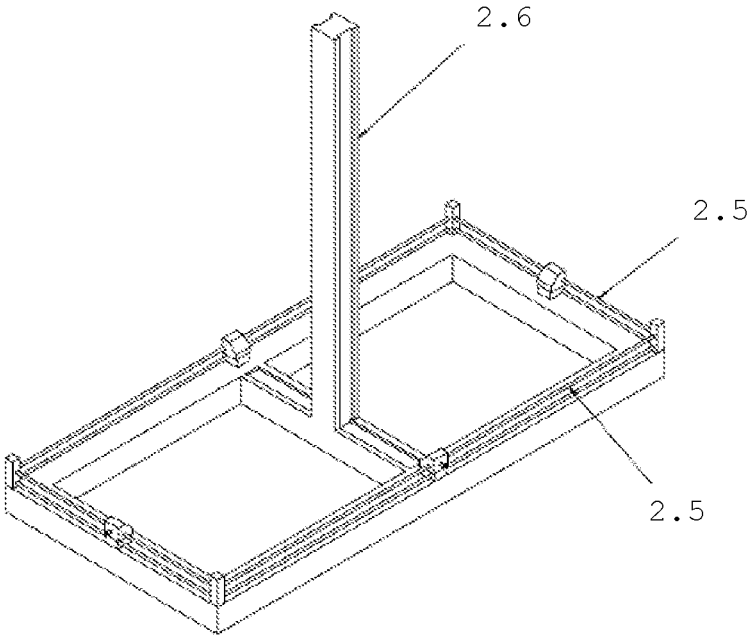

FIG. 9 shows the elevating arm system (2.6) with the bonding product dispenser (2.5) of section 2.

Figure 10:
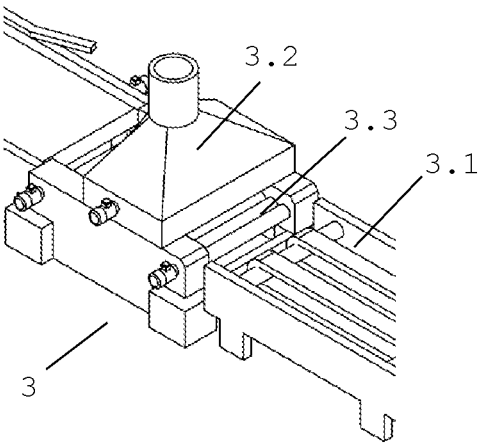

FIG. 10 shows the strip belt (3.1), the aspiration device (3.2) and the group of rolls (3.3) of section 3.

Figure 11:
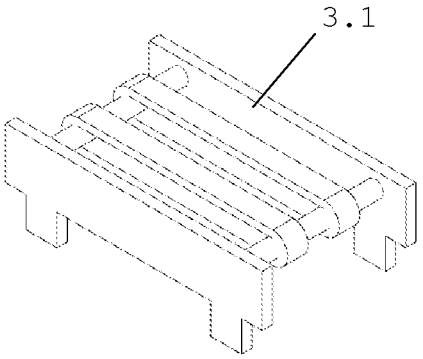

FIG. 11 shows the strip belt (3.1) of section 3.

Figure 12:
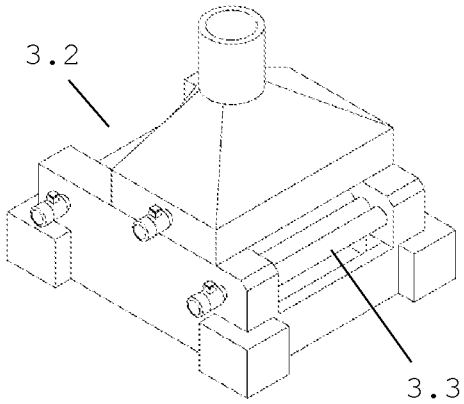

FIG. 12 shows the aspiration device (3.2) and the group of rolls (3.3) of section 3.

Figure 13:
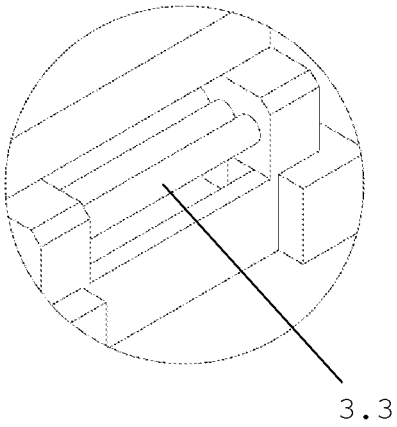

FIG. 13 shows the group of rolls (3.3) of section 3.

Figure 14:
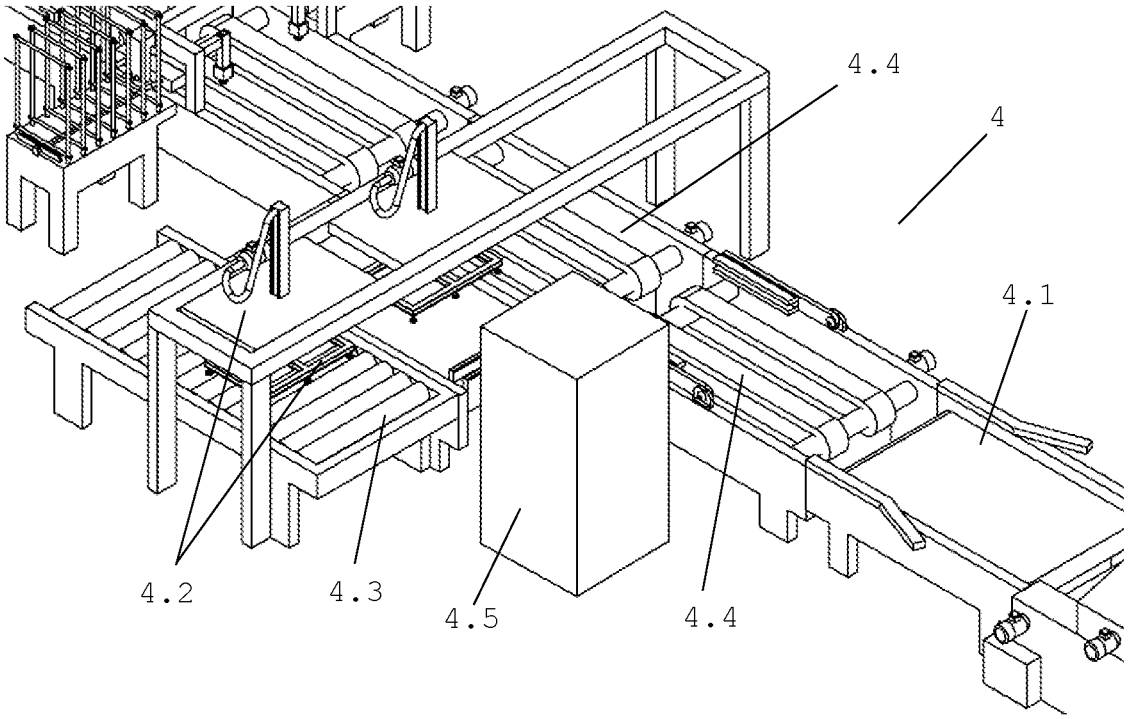

FIG. 14 shows the robotic arm (4.1), the runners and suction cup system (4.2), the station (4.3), the strip belt (4.4) and the controller (4.5) of section 4.

Figure 15:
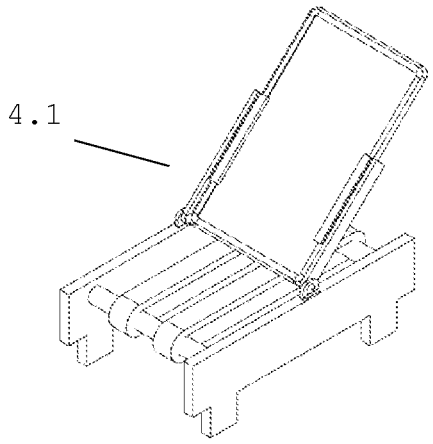

FIG. 15 shows the robotic arm (4.1) of section 4.

Figure 16:
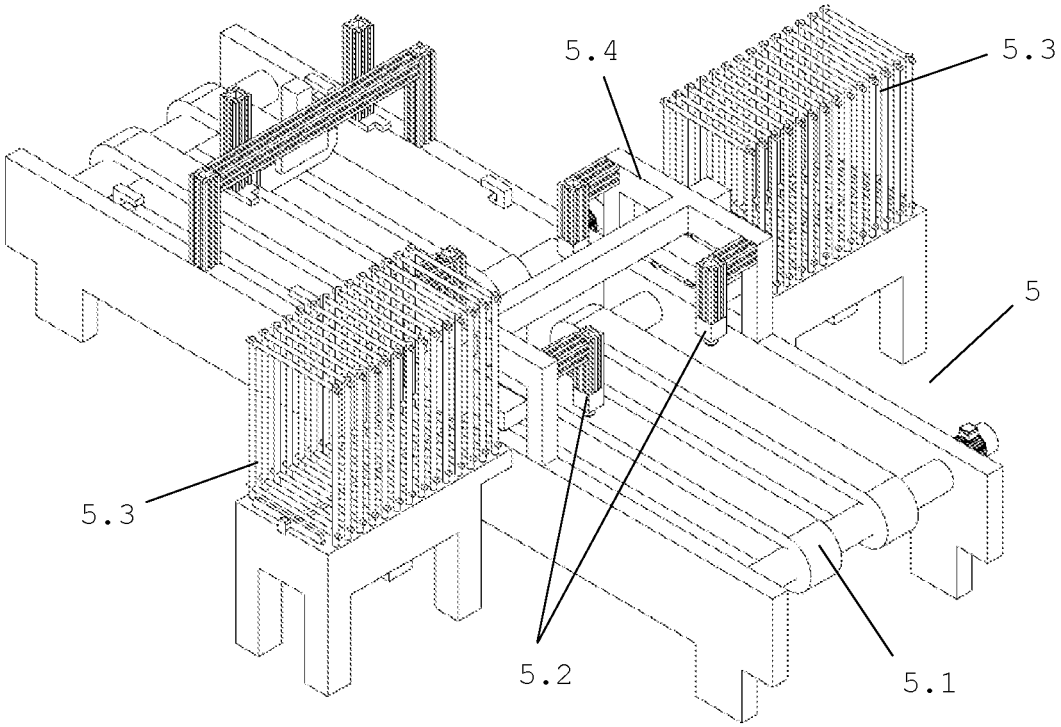

FIG. 16 shows the strip belt (5.1), the bonding product dispensers (5.2), the top feeders (5.3) and the transport system (5.4) of section 5.

Figure 17:
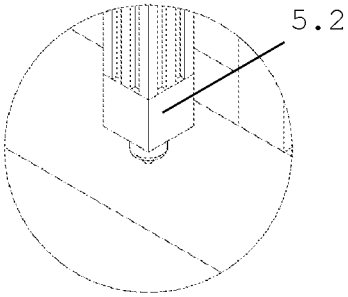

FIG. 17 shows a bonding product dispenser (5.2) of section 5.

Figure 18:
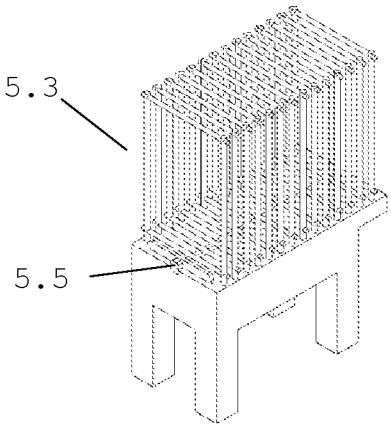

FIG. 18 shows the top feeder (5.3) with a top dispenser (5.5) of section 5.

Figure 19:
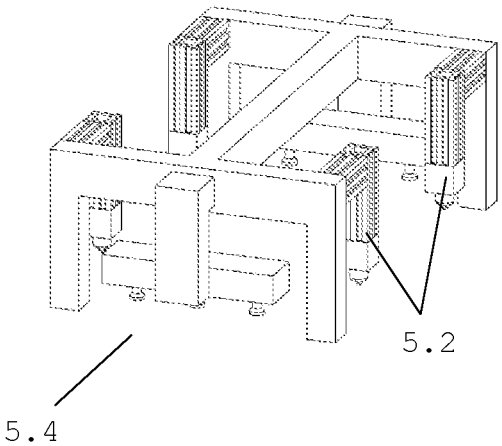

FIG. 19 shows the transport system (5.4) with the bonding product dispensers (5.2) of section 5.

Figure 20:
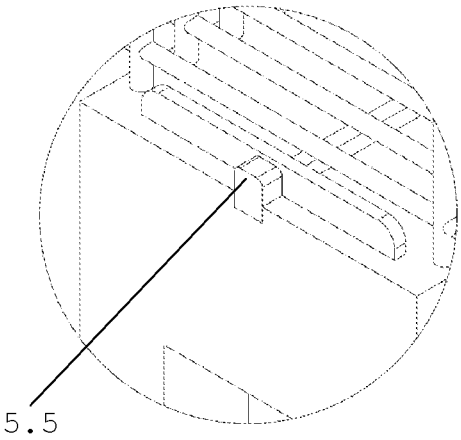

FIG. 20 shows a top dispenser (5.5) of section 5.

Figure 21:
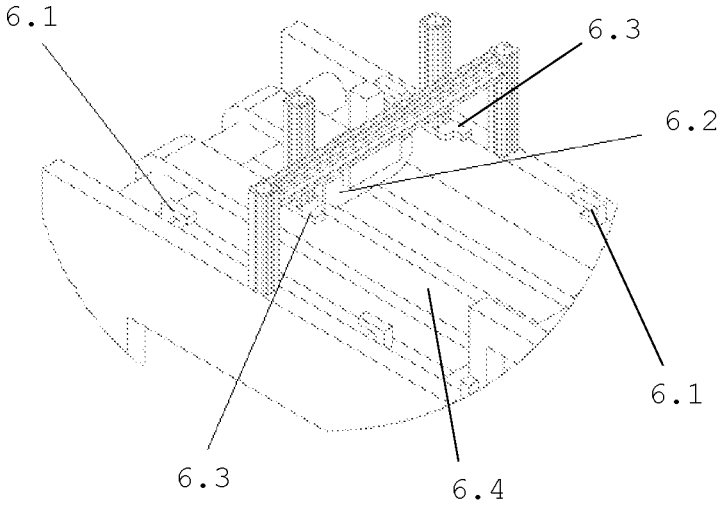

FIG. 21 shows the mechanical arms (6.1), the guillotine (6.2), and the metallic bars (6.3), strip belt (6.4), of section 6.

Figure 22:
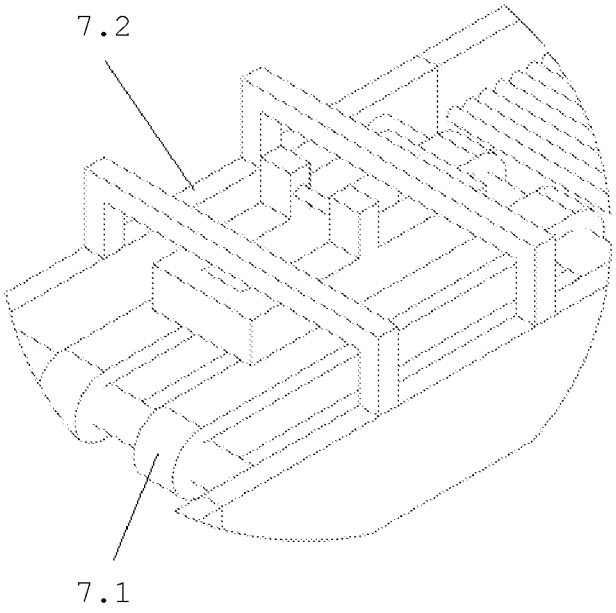

FIG. 22 shows the strip belt (7.1) and the bonding strip dispenser (7.2) of section 7.

Figure 23:
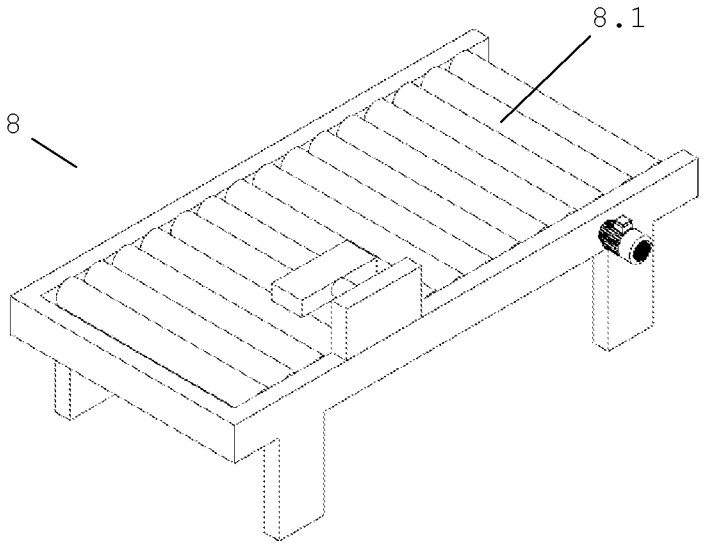

FIG. 23 shows the roller platform (8.1) of section 8.

Figure 24:
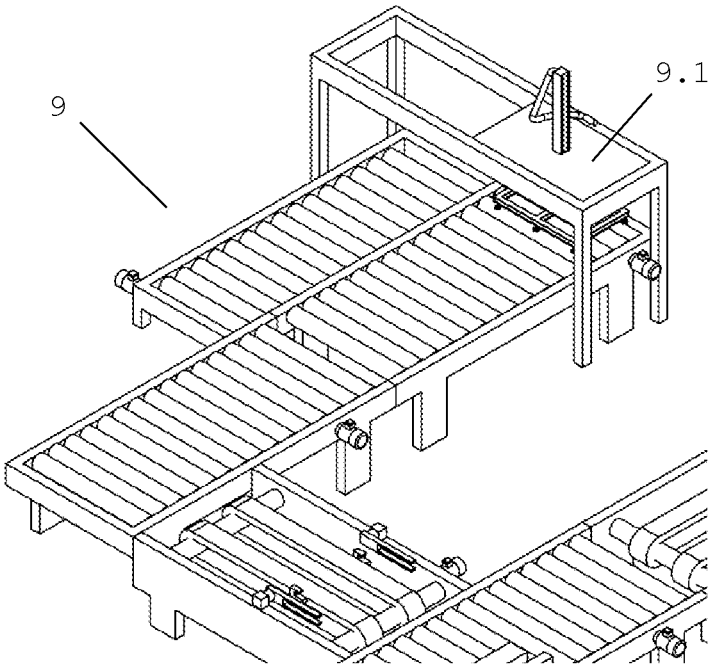

FIG. 24 shows section 9.

Figure 25:
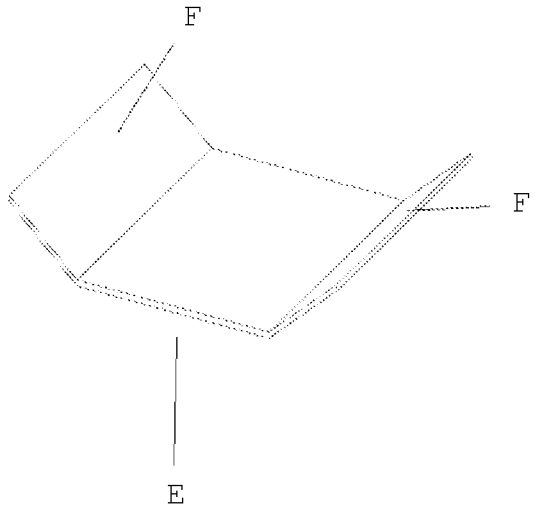

FIG. 25 shows the packaging material (E) and the flaps (F).

Figure 26:
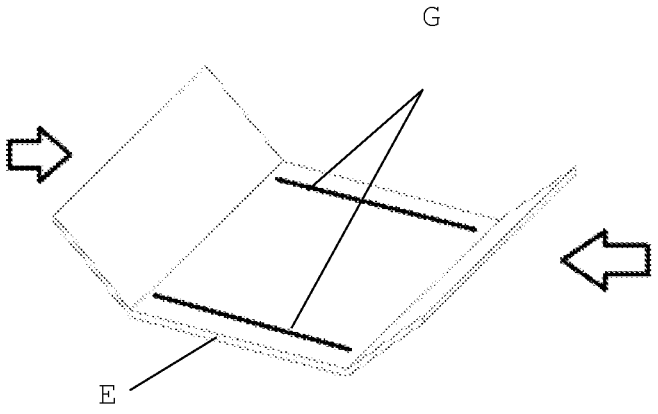

FIG. 26 shows the packaging material (E) and the application zones for the bonding material (G).

Figure 27:
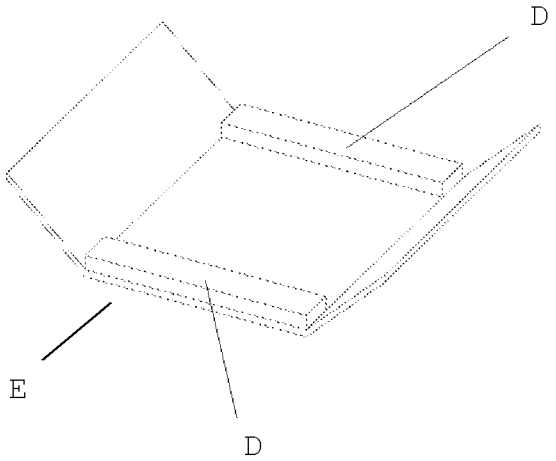

FIG. 27 shows the packaging material (E) and the tops (D).

Figure 28:
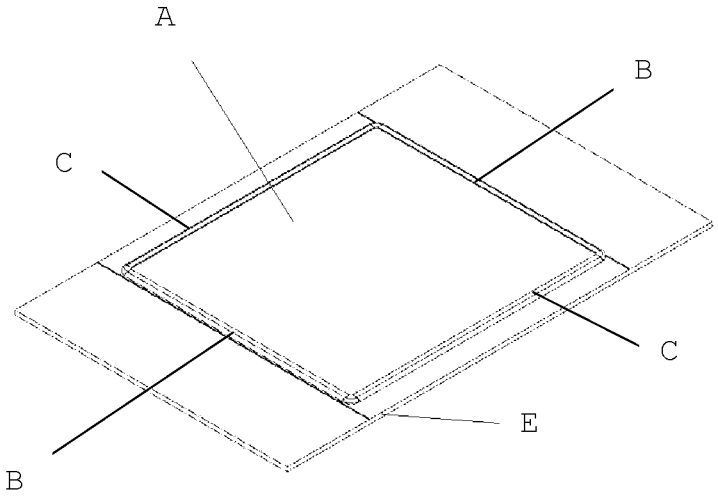

FIG. 28 shows the packaging material (E) with the board (A), the upper profiles (B) and the lateral profiles (C).

Figure 29:
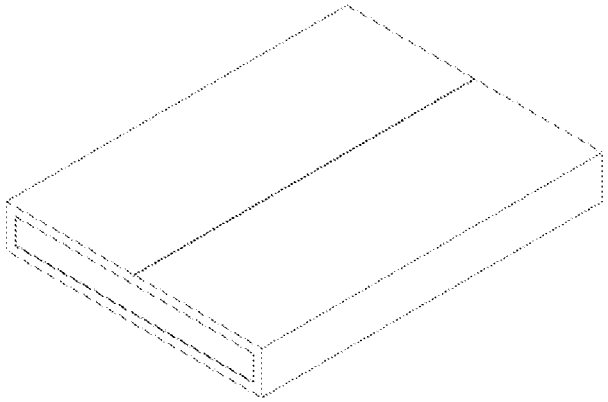

FIG. 29 shows the final product.

DESCRIPTION OF EMBODIMENTS

Referring to the figures, some embodiments are now described in a more detailed manner, which do not intend, however, to limit the scope of the present application.

The present invention refers to a device for packaging of visual communication boards and the respective method of packaging, characterized by a set of at least nine sections.

Description of the Packaging Device

Section 1: Board feeder—according to FIGS. 1 to 5 this section comprises a platform (1.1) consisting of rolls (1.2) where the boards to be packaged are placed. The section comprises two platforms (1.4) one on each side of a strip belt (1.5), wherein the strip belt (1.5) is also adjacent the belt (1.3). Each platform (1.4) can receive boards of different types, which means that the present system can pack different types of boards at the same time. In one embodiment the typology of the boards is the difference in surface and material of the boards (i.e., cork, plate, etc.). To this end, the belt (1.3) can move laterally, according to the collection platform (1.4) which it is intended to feed with the referred boards. The feeder section (1) comprises a controller (1.6) to activate the sequence of entry of the boards and choose which of the collection platforms (1.4) will supply the boards.

This section further comprises an arm comprising suction cups (1.7) to collect the boards from each of the collection platforms (1.4) and place them on a strip belt (1.5), FIG. 5. The arm provided with suction cups (1.7) comprises sensors that activate the vacuum of the suction cups. In one embodiment the sensors are of the electro valve type. Additionally, this section comprises a sensor on the side of the line in the strip belt chassis (1.5) which recognizes the non-existence of a board in the collection platform (1.4). In one embodiment this sensor is of the optical type.

Section 2: Fitting of lateral and upper profiles on the board—According to FIGS. 6 to 9, this section comprises a profile feeder (2.2) integrated in a bonding product machine (2.4), FIG. 8. The profile feeder (2.2) comprises a group of pushers (2.1). The pushers (2.1) have the function of pressing the boards (A).

The profile feeder (2.2) is formed by four sections, each one being comprised of a feeder trough (2.3) where the lateral profiles (C) and the upper profiles (B) are placed, each feeder trough being responsible for dispensing each one of the necessary types of profiles, FIG. 6.

This section further comprises the bonding product machine (2.4) which comprises the bonding product dispenser (2.5) associated to an elevating arm system (2.6), FIG. 9.

Section 3: Cleaning of the boards—According to FIGS. 10 to 13, the section of cleaning of the boards comprises a strip belt (3.1) (FIG. 11), adjacent to an aspiration device (3.2), for cleaning the boards by aspiration of the dust on the surface thereof (FIG. 12), and which comprises a group of rolls (3.3) for placing the boards in cleaning position (FIG. 13).

Section 4: Placing the boards in the package material—According to FIGS. 14 and 15, the section of placing the boards comprises a robotic arm (4.1) to turn the boards 180° (FIG. 15). This section further comprises at least two strip belts (4.4) adjacent the robotic arm (4.1), a runners and suction cup system (4.2) controlled by sensors. In one embodiment the sensors are of the electro valve type. It further comprises a station (4.3) next to the strip belts (4.4) wherein pallets are previously positioned with the packaging material. This section further comprises a controller (4.5) to control this and the following sections of the device.

Section 5: Positioning of the packaging material, distribution of the bonding product on the surface of the packaging material and placing of tops and bonding thereof on the packaging material—According to FIGS. 16 to 20, this section comprises a strip belt (5.1), a transport system (5.4), which comprises bonding product dispensers (5.2) (FIGS. 17 and 19), and two top dispensers (5.3), each on one side of the strip belt (5.1), FIG. 16. The transport system (5.4) is fixed and dispenses the bonding product on the moment of movement of the package product on the strip belt (5.1).

The top dispensers (5.3) comprise one top dispenser each (5.5), FIGS. 18 and 20.

Section 6: Folding the packaging material and seal of package itself—According to FIG. 21, this section comprises a strip belt (6.4), at least four mechanical arms (6.1) which raise and push the flaps of the packaging material. This section further comprises a guillotine (6.2) which centralizes and maintains the position of the board. There also exist in this section at least two metallic bars (6.3) which allow pressing the package product for the bonding product to adhere to the top of the package product.

Section 7: Sealing the packaging material—According to FIG. 22, this section comprises a strip belt (7.1) and a bonding product dispenser (7.2) which places bonding material, preferable glue tape, along the opening formed by the closed flaps of the packaging material, executing the sealing of the package.

Section 8: Labelling—According to FIG. 23, this section comprises a roller platform (8.1) where the operator carries out the labelling of the package.

Section 9— Control and conditioning—According to FIG. 24, the last section of the packaging device operates with sensors, preferably electro valves, strip belts and roller platforms, and a system of air suction cups (9.1) assembled on upper runners which will collect the product on the line and place it over pallets.

Package

According to FIG. 25, the product of the present application consists in packaging material (E) which comprises two lateral flaps (F). The board (A) comprises two lateral profiles (C) and two upper profiles (B), according to FIG. 28. FIG. 28 also shows the board (A) positioned over the packaging material (E) for packaging.

In one embodiment, according to FIG. 25, the bonding product is applied on the bonding material application zones (G) along the length of the packaging material (E). FIG. 27 shows the position of application of the tops (D) on the base of the packaging material (E) and adjacent to the two flaps (F). FIG. 29 shows the final product, the board (A) packed in the packaging material (E).

Packaging Method

The packaging method of the boards begins in section 1 of the packaging device.

Board Feeding—Section 1

The boards (A) to be packed are placed over the rolls (1.2) of the platform (1.1) and directed to the belt (1.3), which in turn places the referred boards in collection platforms (1.4). The belt (1.3) can move laterally to distribute the boards on the collection platforms (1.4). The controller (1.6) of this section makes the rolls (1.2) turn moving the boards to the belt (1.3). A line sensor detects that the boards have entered the belt (1.3) and sequentially the referred belt (1.3) takes the boards to the collection platform (1.4). Next, an arm comprising suction cups (1.7) collects the boards to be packed from each one of the collection platforms (1.4) and positions them on a strip belt (1.5) to pass to the next section.

This collection is previously defined by the operator by means of the choice of the collection platform (1.4) where the boards are placed. Once the collection action is activated, the device enters in a sequential manner in the collection of the boards by means of a sensor. In one embodiment this sensor is an electro valve, which activates the vacuum of the suction cups. The arm provided with suction cups (1.7) moves into position over the strip belt (1.5), releasing the board by withdrawing vacuum at the moment when the next point in line does not have another board. This recognition of the non-existence of a board is made by means of a sensor on the side of the chassis line of the machine, parallel to the plane stopping location. In one embodiment this sensor is of the optical type. This action is successively repeated until the number of boards moved is equal to that defined in the controller (1.6). In the controller (1.6) it is possible to define a time of vacuum, and the speed to the strip belt (1.5). In one embodiment the vacuum time varies between 0 and 20 seconds. In one embodiment the vacuum pressure varies between 700000 Pa and 800000 Pa (7 to 8 bar).

Fitting the Lateral and Upper Profiles—Section 2

As soon as the board (A) is placed in a suitable position, the profile feeder (2.2) dispenses, in a first phase, the upper profiles (B), these being placed on the board and next pressed by the pushers (2.1), so that the referred upper profiles (B) are coupled to the board (A). Next the profile feeder (2.2) dispenses the lateral profiles (C), which are pushed by another group of pushers (2.1) so that they can couple to the board (A).

Even prior to the assembly of the lateral profiles (C) and the upper profiles (B) to the board, a bonding product is applied to the tears of the lateral profiles (C) and of the upper profiles (B) by the bonding product machine (2.4), particularly with the aid of the elevating arm (2.6) and to the bonding product dispenser (2.5). It must be noted that the entry movements of the boards, the feeding of profiles and the assembly system of the same to the board as well as the application of the bonding product on the tears of the profiles are ordained by means of the control with sensors, controlled by the controller (1.6). Finally, after these operations the order is given by the controller (1.6) for the board to pass to the next section. It must be noted that the controller can also be remotely operated at a distance, by remote means and further, in digital manner in a panel. In this panel all steps of the line are controlled.

The bonding product is directly controlled on the machine where it is deposited (2.4). The parameters controlled are the temperature between 140 and 170° C. and application pressure from 200000 Pa to 350000 Pa (2 to 3.5 bar). The speed of the dispenser (2.5) is also controlled. After detection by the sensor that there is no board in the next position in line, the strip belt (1.5) moves the board to the position defined in the centre of this assembly section. The pressure of the pushers (2.1) is also specified in the controller (1.6).

Cleaning of Boards—Section 3

Subsequently to the assembly of the lateral profiles (C) and of the upper profiles (B), the boards are directed by means of a strip belt (3.1) to an aspiration device that cleans the surface of the board. The strip belt (3.1) places the boards in position by means of a group of rollers (3.3) and after cleaning, these are forwarded to the next section.

Placing of Boards in the Packaging Material—Section 4

Subsequently to the section of cleaning of the boards, the same will be operated by a robotic arm (4.1) which will turn the board 180°. This turn is operated when the runners and suction cup system (4.2), downstream to the line, is in a position pre-defined by the controller (4.5). That is, the useful surface of the board is rotated and turned upside down. This allows the board to be assembled in the most correct position for prevention of damages. Subsequently to this operation, this runners and suction cup system (4.2), which works by air suction and is controlled by sensors, which in one embodiment are of the electro valve type, is programmed so that the packaging material (E) is collected from a station (4.3) and placed in line in due time to receive the boards. For this purpose, a sensor, which in one embodiment is of the electro valve type, existing in the system (4.2) detects the existence of packaging material (E) to feed the line. This command is given for the first time by the operator in the controller (4.5). Subsequently it works in a sequential manner, as follows: as soon as the packaging material (E) is detected by the sensor, the vacuum is activated; subsequently the system (4.2) moves the packaging material (E) to the position defined in the program of the controller (4.5); at this moment the vacuum is turned off and the packaging material (E) is released for the strip belt (4.4); the turning of the board, previously mentioned, occurs at this moment and next the system (4.2) collects the board once more, and places it over the packaging material (E). For this purpose, there exists a station (4.3) next to the line, where pallets are previously placed with the packaging material (E) to be used. Subsequently, the board is positioned over the packaging material (E). In this operation the sensors and the automatic control identify the moment when the robotic arm (4.1) will lift the board to the line by means of a system of suction and air cups (4.2), and place it centred over the package material (E) previously placed in line. Following these operations, the set consisting of the packaging material (E) and the board (A) passes to the next section.

Positioning the Packaging Material and Distribution of Bonding Product—Section 5

During the movement of the board and of the packaging material on the strip belt (5.1) a bonding product is applied by means of a bonding product dispenser (5.2). When the sensors indicate that there is no board in the next position, a conveyor belt (5.1) moves the packaging material (E) with the board (A) and causes the bonding product to be dispensed over the extremities of the packaging material. The quantity of bonding product is pre-defined in the controller (4.5) and depends on the speed of the conveyor belt (5.1), and on the temperature between 145 and 170° C. and application pressure defined directly in the dispenser between 200000 Pa and 300000 Pa (2 to 3 bar). It is emphasized that, preferably, hot glue is applied, whereby the application points are previously defined in the controller (4.5), as shown in FIG. 26.

It must be noted that the tops (D) of the packaging material (E), apart from avoiding the incorrect movement of a board within the package (E), receive a set of components for assembly of the board by the final user. Previously to the placing thereof in the packaging material (E), a top feeder (5.3) is charged with placing the tops (D) in a position to be subsequently applied to the packaging material (E). The tops (D) are manually placed by an operator in the top feeder (5.3). At the end of this top feeder (5.3) there exists a sensor, preferably an electro valve, which detects if any top (D) is correctly positioned, so that a transport system (5.4) can move it to position over the packaging material (E). At the moment when there is a movement from the top (D), a top dispenser (5.5) will move all the tops (D) in the top feeder (5.3) in direction to the end where the sensor is. If everything is aligned, the top (D) is released over the bonding product previously applied, all in a sequential manner.

After fixing the tops (D) as referred in the previous section, the application of a bonding product is executed once more, particularly hot glue, by means of a dispenser (5.2), over the tops (D) which have just been fixed to the packaging material. This means that the bonding product is applied on both faces of the tops (D) as well as in the packaging material (E) allowing the junction of the packaging material itself subsequently to the folding procedure.

Folding the Packaging Material and Package Seal—Section 6

In order to be able to fold, a set of mechanical arms (6.1) raises and pushes the flaps (F) previously defined in the packaging material (E), in a manner so that it closes, while a guillotine (6.2) centres and maintains the positioning of the board and the package, formed meanwhile, so that there is a subsequent pressing by means of metallic bars (6.3) which allow the bonding product to adhere from the top of the package to the flaps (F). The simplicity of the final package and of the operation allows a production rhythm aligned with the remaining steps of the process, where previously an intense manual labour was necessary to achieve it.

Sealing the Package—Section 7

Subsequently to the previous step, the controller (4.5) gives the order for the package, already holding the board in its interior, to proceed on a belt to the steps of sealing and labelling. This order is given by the controller (4.5) in a sequential manner when the line sensor does not detect any package in the next position. The package is centred and positioned to pass through a dispenser (7.2) which will preferably dispense adhesive tape. The adhesive tape is placed over the junction line of the flaps (F) in the centre of the closed package.

Labelling the Package—Section 8

In this section an operator executes the manual labelling of the sealed package when this is in the roller platform (8.1).

Control and Conditioning—Section 9

In this section the packages are subjected to the quality control on the part of the operator and an air suction cup system (9.1) executes the conditioning of several packages on pallets.

It must be noted that the package is specifically designed to adapt both to the product to be packed, visual communication boards (A) as to the packaging method itself. The packaging material (E) to be used consists solely of a lignocellulosic material plate, which will surround the product to be packed. The top (D) of the package is an additional element to the package itself. According to the geometry of the package, joined with the top (D) of the package, empty spaces are not allowed subsequently to packaging the product.

The packaging material (E) is cut with the measures that are suitable to the product to be packed. In one embodiment, the packaging material has the measurements of 1042×1268 mm and the closed box has the measurements of 1042×610×24 mm. The packaging material is creased as illustrated in FIG. 25 by the supplier itself. Thus, other handlings are avoided as well as production processes that increase the cost of the referred package.

By means of the reduction in the material used in the production of the package, the same is lighter than the packages destined to the same purpose which exist currently.

There is no overlaying of material, the adjustment of the package to the product is efficient, and there is efficacy in the protection of the product, and the volume per product is kept to a minimum, thus there may be a higher number of products in the same transport.

The simplicity of the package herein described makes it necessary just to fold the creases, whereby everything can be done in an automatic manner, having a packaging cycle time adjusted to the cycle time of production of the product, with reduced need of labour.

The critical points in the protection of the product are mainly the edges and corners. This is due to the fact that, when being handled, and due to the dimensions thereof, it may fall to the ground, usually over the edges or corners. In this sense the edges and corners are the points which must receive most protection. The tops (D) of the package guarantee this protection, cushioning the product inside the package, there not being contact of the product with the ground in case of fall of the packed product to the ground.

Following the steps defined by the ISTA 3A (2008) norms, for package tests, the packaged boards are dropped to the ground nine times and the state of the product is subsequently analysed. The nine drops are carried out at a pre-defined height from the ground, three times on the longest edge of the package, followed by three times on the edge of the package top and finally three times on the corner of the junction of these two previously tested edges.

These package tops, apart from effectively protecting the packed product, also allow the correct packaging of accessories that are necessary to the product. Thus, the accessories are not lost and do not cause damage to the product itself.

Ease of Opening by Final Client

The opening of the package by the final client consists in solely removing the adhesive tape placed in the junction of the flaps (F). This meets the requirements of the market and clients, wherein the opening of the package must be quick and easy. The board (A) has the back face turned upwards to this opening which means that if any final client executes an imprudent handling by means of the use of cutting tools to remove the adhesive tape, this will not cause damages on the useful surface of the product.

All the accessories that are necessary to the installation/assembly of the product by the client are well packed, identified and together.

The invention claimed is:

1. Device for packaging of visual communication boards characterized by comprisingat least the following sections:

Section 1 adapted for feeding of the boards;

Section 2 adapted for fitting the lateral and upper profiles;

Section 3 adapted for cleaning of the boards;

Section 4 adapted for placing of boards on packaging material;

Section 5 adapted for positioning the packaging material, distribution of bonding product on the surface of the packaging material and placing of tops on the packaging material;

Section 6 adapted for folding the packaging material and package seal;

Section 7 adapted for sealing the packaging material;

Section 8 adapted for labelling the package;

Section 9 adapted for control and conditioning.

2. Device for packaging according to claim 1, characterized by the section 1 comprising a platform (1.1) consisting of rolls (1.2), and which is adjacent to a belt (1.3); two platforms (1.4), one on each side of a strip belt (1.5), where the strip belt (1.5) is also adjacent to the belt (1.3); a controller (1.6); an arm provided with suction cups (1.7) with electro valve type sensors; and an optical type sensor on the strip belt (1.5).

3. Device for packaging according to claim 1, characterized by section 2 comprising a profile feeder (2.2) formed of four sections, each section comprised of a feeder trough (2.3), where the profile feeder (2.2) is integrated in a bonding product machine (2.4), and wherein the profile feeder (2.2) comprises a group of pushers (2.1); the bonding product machine (2.4) comprises the bonding product dispenser associated to an elevating arm system (2.6).

4. Device for packaging according to claim 1, characterized by section 3 comprising a strip belt (3.1), adjacent to an aspiration device (3.2), and wherein the aspiration device (3.2) comprises a group of rolls (33).

5. Device for packaging according to claim 1, characterized by section 4 comprising a robotic arm (4.1); at least two strip belts (4.4) adjacent to the robotic arm (4.1); a runners and suction cup system (4.2) controlled by electro valve type sensors; a station (4.3) next to the strip belts (4.4); a controller (4.5).

6. Device for packaging according to claim 1, characterized by section 5 comprising a strip belt (5.1); a transport system (5.4) which comprises bonding product dispensers (5.2); two top dispensers (5.3), one on each side of the strip belt (5.1), and which comprise one top dispenser each.

7. Device for packaging according to claim 1, characterized by section 6 comprising a strip belt (6.4), at least four mechanical arms (6.1), a guillotine (6.2) and at least two metallic bars (6.3).

8. Device for packaging according to claim 1, characterized by section 7 comprising a strip belt (7.1) and a bonding material dispenser (7.2).

9. Device for packaging according to claim 1, characterized by section 8 comprising a roller platform (8.1).

10. Device for packaging according to claim 1, characterized by section 9 comprising sensors of the electro valve type, strip belts and roller platforms, and a system of air suction cups (9.1) assembled on upper runners.

11. Method of packaging visual communication boards in the device described in clann 1, characterized by comprising the steps of:

feeding the boards in section l by means of the movement of the boards on the platform (1.1) and the belt (1.3) until the platforms (1.4), where the belt (1.3) moves horizontally to distribute the boards over the platforms (1.4), collecting the boards by means of the arm provided with suction cups (1.7) with a vacuum between 700000 Pa and 800000 Pa and time between 0 and 20 seconds, and placing the boards on the strip belt (1.5), the entire operation being controlled by the controller (1,6);

fitting of lateral and upper profiles in section 2, where the bonding product machine (2.4) dispenses bonding product on the profile tears, and where the profile feeder (2.2) dispenses upper profiles and lateral profiles, pushed by pushers (2.1);

cleaning of the boards in section 3, where the boards are directed to a strip belt (3.1) wherein the aspiration device (3.2) cleans the surface of the board;

placing the boards on the packaging material of section 4, wherein the runner and suction system (4.2) collects the packaging material from the station (4.3) and places it on the strip belt (4.4), the robotic arm (4.1) turns the board 180° and the runner and suction cup system (4.2) places the board over the packaging material;

positioning the packaging material and distribution of the bonding product in section 5, wherein the bonding product of the packaging material is applied on the packaging material by means of the dispenser (5.2), the top feeders (5.3) dispense tops for the packaging material, and the dispenser (5.2) applies bonding product to the tops;

folding the packaging material and package seal in section 6, wherein a set of mechanical arms (6.1) pushes the flaps of the packaging material, the guillotine (6.2) centralizes and maintains the position of the board and the package, and the metallic bars (6.3) press the package closed;

sealing the package in section 7, wherein a dispenser (7.2) dispenses adhesive tape over the flap joining line in the centre of the closed package;

labelling in section 8, for placing the label on the package;

control and conditioning in section 9, where the quality control and conditioning of several packages is carried out.

* * * * *